United States Patent [19]

Cooke

[11] 4,355,602

[45] Oct. 26, 1982

[54] BOILER

[75] Inventor: George Cooke, Willowdale, Canada

[73] Assignee: Cedar Dunes Investments Ltd., Ontario, Canada

[21] Appl. No.: 291,693

[22] Filed: Aug. 10, 1981

[51] Int. Cl.[3] ..... F22B 15/00; F22B 7/00

[52] U.S. Cl. ..... 122/235 R; 122/6 A; 122/155 A; 122/135 F; 122/155 F

[58] Field of Search ..... 122/2, 6 A, 135 F, 155 R, 122/155 A, 155 F, 235 R, 235 A, 235 F, 235 K, 235 V, 238, 262, 239

[56] References Cited

U.S. PATENT DOCUMENTS

| | | | |
|---|---|---|---|
| 2,033,077 | 3/1936 | Kerr et al. | 122/6 A |
| 2,119,606 | 6/1938 | Stauffer | 122/155 F |
| 2,633,107 | 3/1953 | Mandelburg | 122/155 F |
| 2,826,182 | 3/1958 | Mandelburg | 122/155 R |
| 3,195,516 | 7/1965 | Votkauf | 122/235 R |
| 3,382,848 | 5/1968 | Northcote et al. | 122/235 R |
| 3,478,724 | 11/1969 | Brunner | 122/155 A |
| 3,703,161 | 11/1972 | O'Connor | 122/235 R |
| 4,123,995 | 11/1978 | Ek | 122/235 R |
| 4,206,723 | 6/1980 | Kunkel | 122/2 |
| 4,237,824 | 12/1980 | Svensson | 122/235 R |

*Primary Examiner*—Henry C. Yuen

*Attorney, Agent, or Firm*—Sprung, Horn, Kramer & Woods

[57] ABSTRACT

A highly efficient boiler is made up of a housing containing upper and lower left and right water manifolds. Tubes connect the left manifolds and other tubes the right manifolds. The tubes are bent toward one another to form a plurality of superposed chambers through which combustion gases must successively flow, from front to back in one chamber and from back to front within the next. Baffles may be provided in each chamber to cause the gas to traverse a sinuous path from left to right and right to left within each chamber. Adjustment of the baffles can be effected during operation to keep the combustion gas exit pressure or temperature or flow rate constant notwithstanding changes in the liquid flow rate through the tubes or the rate of combustion of fuel in the lowermost chamber.

5 Claims, 7 Drawing Figures

22
12
4
34
34
26
26
10
18
40e
30
30
36c
40d
46
36
40c
16
40b
46
36b
38
32
40a
4
24
36a
20
24
28
28
14

BOILER

The present invention relates to a novel construction of a boiler and similar heat exchangers for heating water while cooling hot gases which are the products of combustion.

Boilers are classified into two distinct types commonly known as fire tube and water tube boilers. A fire tube boiler transfers heat to the water by moving hot gases along the inside of small tubes in a controlled path. The water is in a large mass and, except for natural convection forces, the water is stationary. A water tube boiler transfers heat by confining the water in small tubes which causes the water to flow rapidly upwards, creating controlled rapid water circulation. The hot gases are not controlled to any absolute specific path. Fire tube boilers are the more economical type up to 20,000 pounds of steam per hour capacity whereas water tube boilers are the more economical for capacities over 20,000 pounds of steam per hour.

Both boiler types are designed to run at a fuel to water efficiency of 80 per cent. To obtain higher efficiencies both types of boilers must go to expensive additional equipment and these decisions are usually made on a job-by-job basis, depending on the particular application.

Numerous designs exist but it is an object of the present invention to provide one which is simple to construct, assemble and operate, which is highly efficient and capable of handling varying loads, and which is suitable for use on large scale as in large buildings, industrial electric and co-generation plants as well as in relatively small residential installations.

These objects are realized in accordance with the present invention pursuant to which there is provided a boiler comprising a housing having a top provided with a gas outlet, bottom, left and right sides and a front and back, and within the housing an upper manifold and lower manifold or manifolds substantially parallel to the top, bottom and side walls, two sets of tubes, each set comprising a plurality of tubes, one set joining the upper left side of the manifold to the lower left side of the manifold and the other set joining the upper right side of the manifold to the lower right of the manifold, the tubes of each set rising from their lower manifold upwardly along their respective side wall, crossing the housing to the opposite side wall, re-crossing the housing to their respective side wall, rising therealong and eventually joining their upper manifold, the horizontal runs of the tubes of one set being vertically offset relative to the horizontal runs of the tubes of the other set so as to form a plurality of superposed chambers, at least one tube of each set being differently bent from the others of that set so as to form access openings from each chamber to the chambers above and below, the openings from chamber to chamber being offset so as to require a gas flowing through said chambers to traverse one chamber from front to back and the next chamber from back to front, means for introducing liquid into one of the manifolds and for withdrawing the liquid from the outer manifold, and means for introducing a combustion gas into the lowermost of the superposed chambers, the combustion gas rising successively through the chambers which is successively and alternately traverses from front to back and then from back to front until it exits from the uppermost chamber through the gas outlet in the top, liquid flowing through the manifolds and tubes being heated by the combustion gas.

Advantageously the tubes of each set are in substantial contact with one another so as substantially to prevent passage of combustion gas therebetween. In a preferred embodiment there is provided at least one baffle within at least one of the chambers extending from top to bottom and from one of the sides toward but terminating short of the other side, whereby combustion gas traversing that chamber from front to back is additionally forced to flow laterally to get around said baffle.

The boiler meets all of the requirements of the American Society of Mechanical Engineers boiler and pressure vessels, sections I and IV, which are recognized by agencies of most governments. The novel boiler incorporates the best features of the fire tube boiler by controlling the passage of hot gases and, by confining the water within small tubes, takes advantage of the best features of the water tube boiler.

All internal parts and surfaces are easily accessible for service and cleaning so the unit is suitable for burning light oil, residual oils, crude oils, waste oils, any type of gas, any type of coal or solid fuel including municipal waste.

The invention will be further described with reference to the accompanying drawings, wherein.

Figure 1:
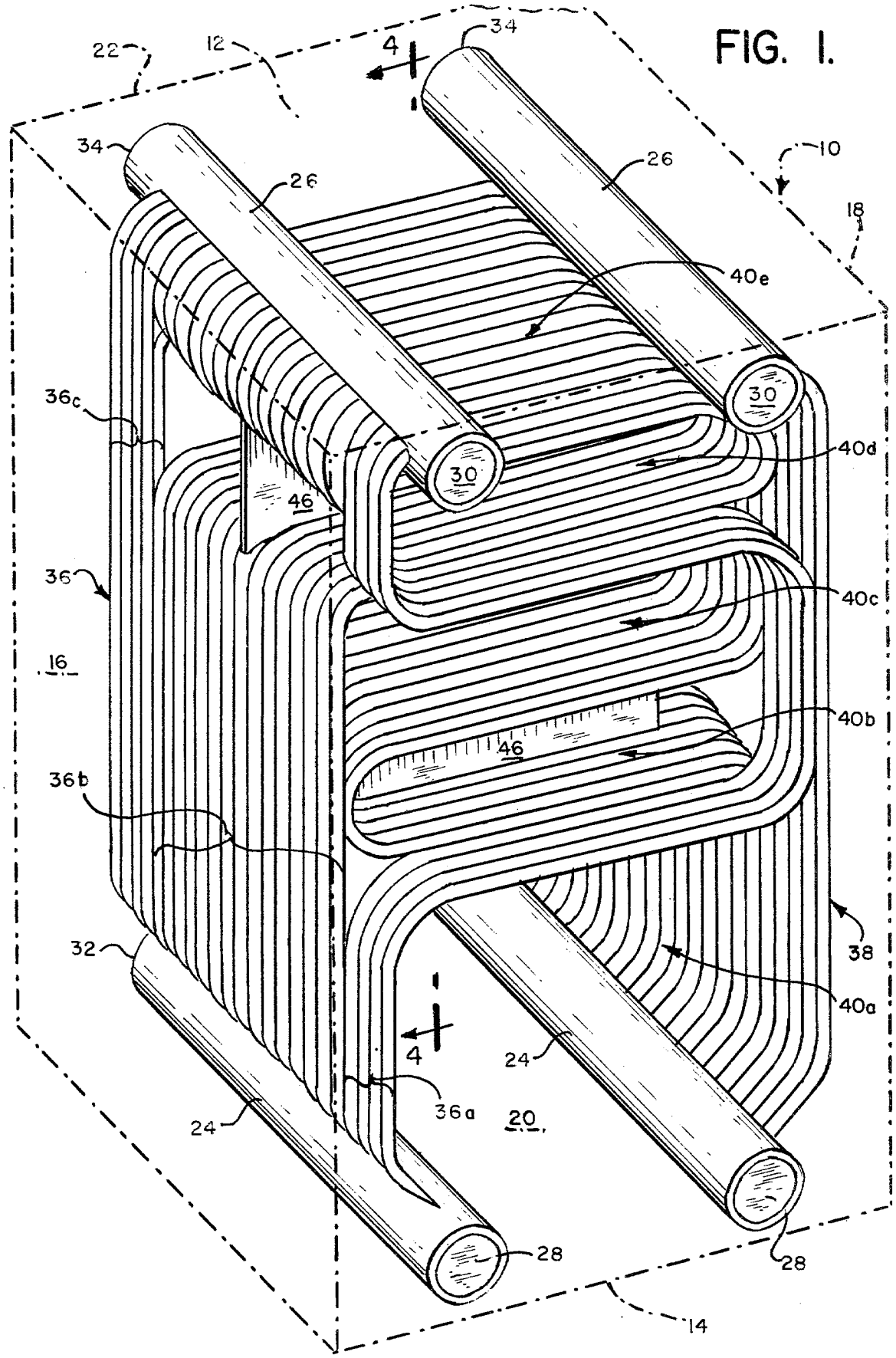
FIG. 1 is a perspective view of a boiler in accordance with the invention, with the housing shown in phantom.

Referring now more particularly to the drawings, in FIG. 1 there is shown a housing 10 having a top wall 12, a bottom wall 14, a left side wall 16, a right side wall 18, a front wall 20 and a rear wall 22. A pair of lower manifolds 24 and a pair of upper manifolds 26 extend forwardly from the rear wall 22. The forward ends 28, 30 of the manifolds 24, 26 are sealed but the rearward ends 32, 34 are open and the upper manifolds are joined by some piping (not shown) as are the lower manifolds so single pipe can supply liquid to both manifolds of a pair (either upper or lower) and another single pipe (not shown) can withdraw liquid from the other pair.

A plurality of tubes 36, illustratively twenty-three, extend from the left upper manifold 26 to the left lower manifold 24 and a similar manner of tubes 38 extend from the right upper manifold 26 to the right lower manifold 24. Except for the first **36*a* and last 36*c* few tubes in each set, for a reason to be described later, the balance of the tubes 36*b* are all similarly bent as are the tubes 38**.

Figure 2:
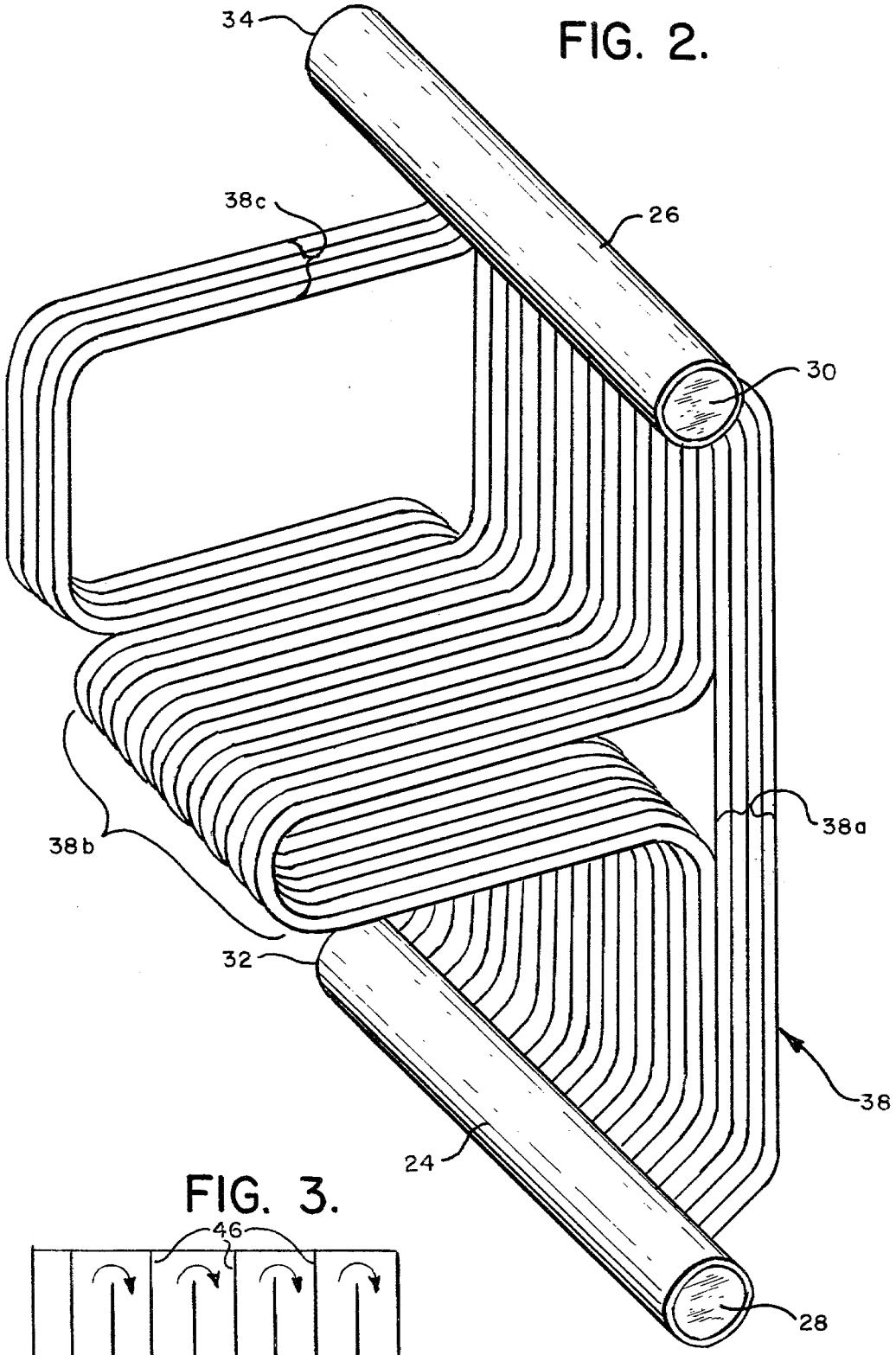
FIG. 2 is a perspective view of the upper and lower right-hand side manifolds of FIG. 1. with the interconnecting tubes.

FIG. 2 shows the tubes 38 and their manifolds 24 and 26 in the same positions as in FIG. 1. Each tube has a vertical component and tubes **38*a* and 38*b* have two horizontal components, i.e. one run to the left side of the boiler, or actually to the tubes 36, and then a return run. The bends in tubes 38 are not identical to those of tubes 36 but rather complementary so that together they form a series of vertically superposed chambers 40***a*, 40*b*, 40*c*, 40*d* and 40*e*.

Figure 4:
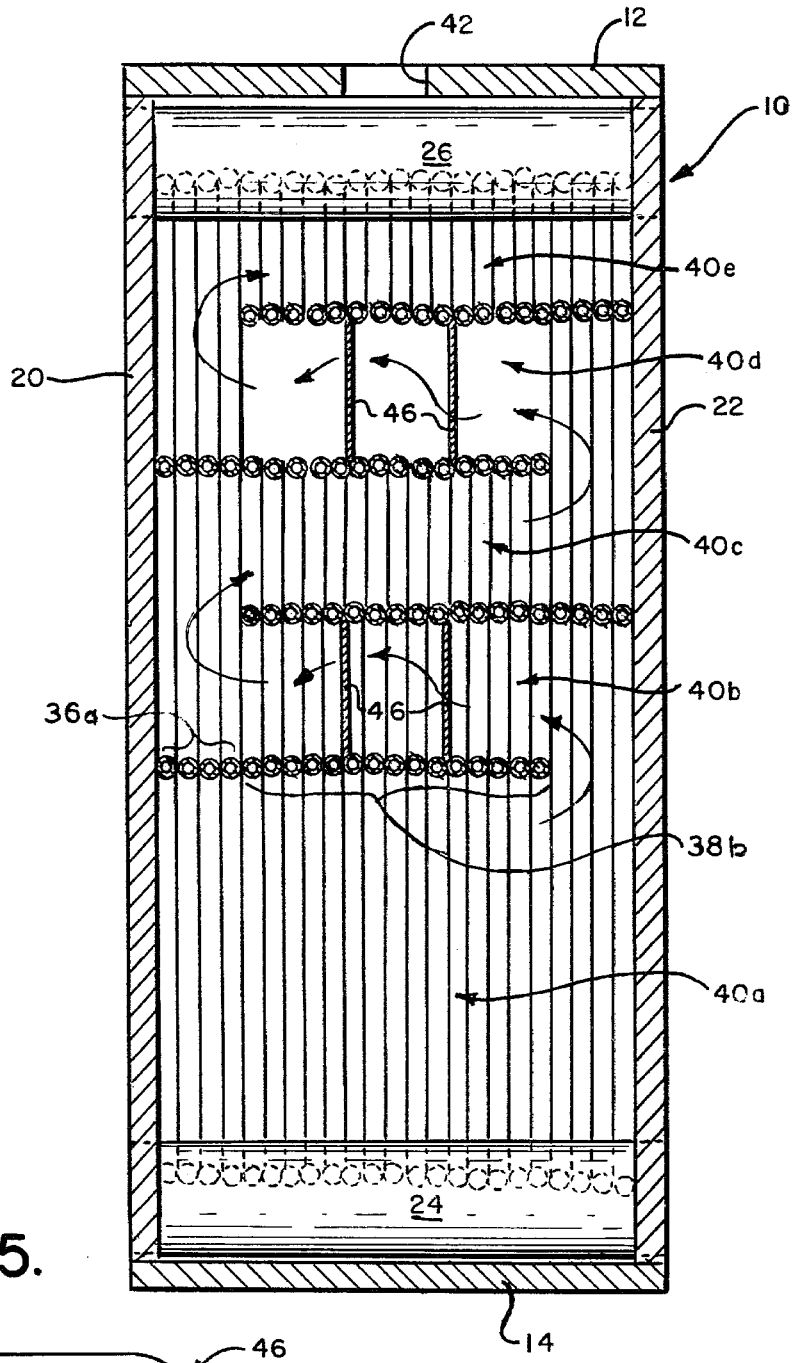
FIG. 4 is a sectional view along line 4—4 of FIG. 1.

This is best seen in FIG. 4 where the ceiling of chamber 40*a* is made up of tubes 36*a* and 38*b* but there is no ceiling for the space of 36*c* or 38*c*. Consequently combustion gases in chamber 40*a* rise through such space and enter chamber 40*b* traversing it horizontally from right to left in FIG. 4, corresponding to from back to front in FIG. 1. The tube bends similarly cause the gases to traverse successive chambers until they reach the topmost chamber 40*e* where they exit through an opening 42 in the top 12.

Figure 5:
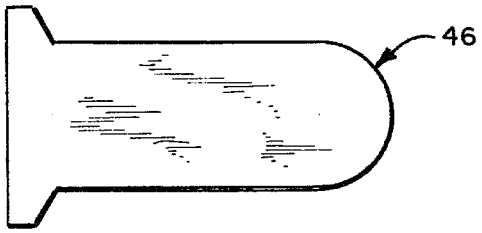
FIG. 5 is a plan view of a baffle of FIGS. 1, 3 and 4.

For improved heat exchange, in addition to the tortuous gas flow so far defined, a more complex flow is possible. Thus baffles 46 having the shape shown in FIG. 5 may be provided. They extend from adjacent one side wall toward but short of the other. They are just high enough to span a chamber (40*b* and 40*d* in FIG. 4) being held in position by their fit between the troughs formed by adjacent tubes. They are inserted by simple sliding and may be removed, or slid more or less into their chambers, either manually or automatically (not shown), as desired.

If more than one baffle 46 is present in a given chamber they must alternately extend from opposite sides. Thus while the combustion gas is moving from rear to front in chamber 40*b* in an absolute sense (from right to left in FIG. 4) the gas stream must move from side to side to get around the baffles. In FIG. 4 a few of the tubes have not been shown in chamber 40*d* to facilitate understanding of the gas flow path about the baffles but such tubes are of course present.

Figure 3:
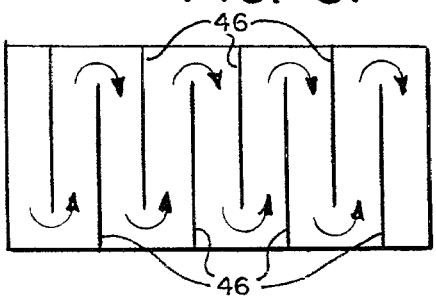
FIG. 3 is a top plan view of the gas flow across one of the baffled chambers in FIG. 1.

FIGS. 1 and 4 show two baffles in but two chambers but greater numbers can be provided to effect greater baffling and heat exchange, depending upon the demands of the boiler, the rate of combustion, the gas pressure and the desired gas velocity. Thus in FIG. 3 the flow path through one chamber 40 is shown where a multiplicity of baffles 46 is provided. The baffling can be adjusted during operation to maintain a constant flue gas pressure even though the combustion rate is changed, for example.

It can be seen that by opening or removing the left side wall 16, for example, ready access can be gained to all the tubes 38 extending between manifolds 24 and 26. Thus the entire tube set and manifolds can be replaced or individual tubes can be replaced without affecting the tubes 36 making up the complementary set. Any individual tube contacts its laterally adjacent tubes snugly so as to prevent any significant gas leakage therebetween but at the same time not so snugly that it cannot be removed and replaced.

The combustion gases are generated in chamber 40*a* in conventional manner as by a burner (not shown) supplied with oil, natural gas or coal, or a turbine exhaust is supplied to the chamber. Water is supplied to the manifolds to flow either co-currently or countercurrently to the gas flow, as desired. The upper manifolds are either directly connected to one another by additional piping (not shown) outside the boiler or they are indirectly connected as by being supplied from, or exitting into a common collector; this applies to the lower manifolds as well.

Figure 6:
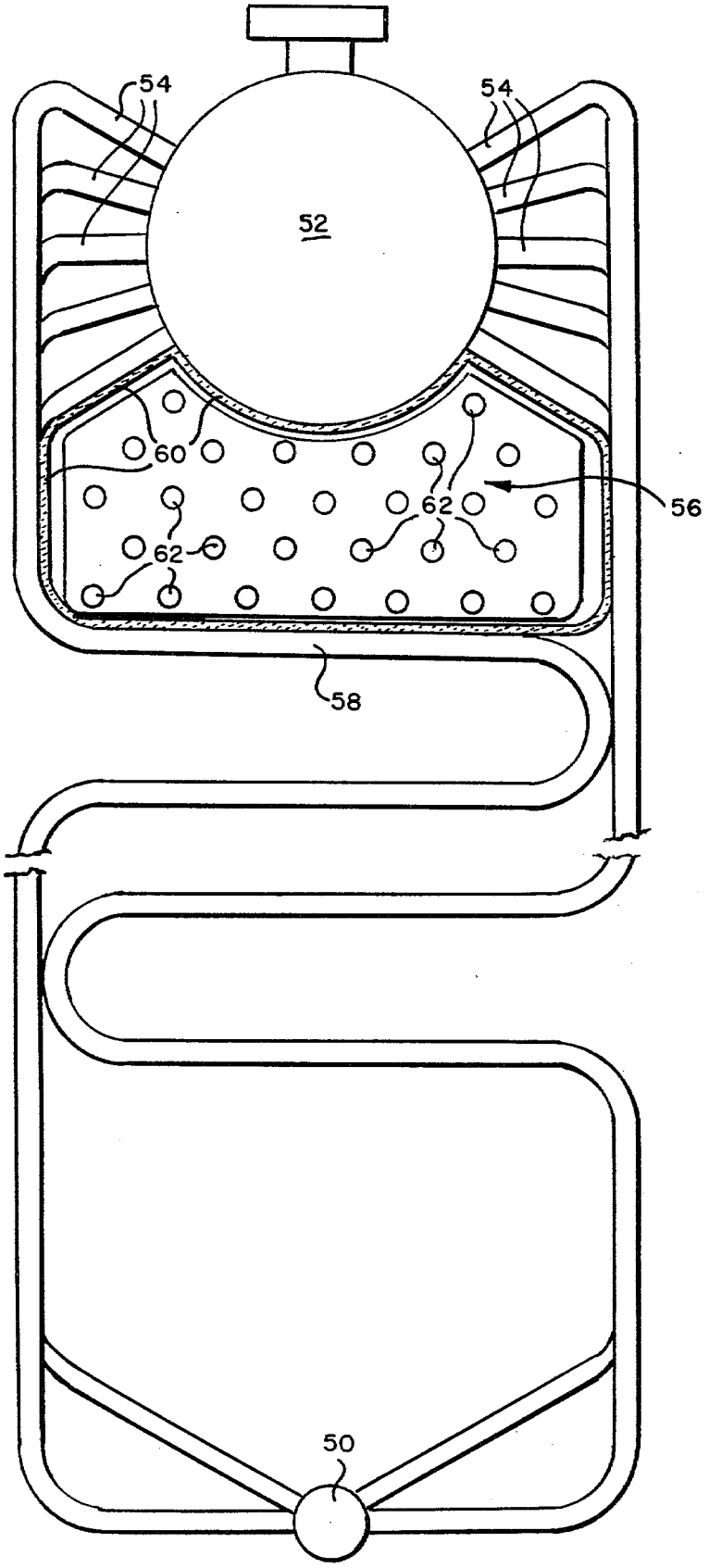
FIG. 6 is a front view of the tube portion of another boiler in accordance with the present invention.

In the embodiment shown in FIG. 6 the lower water manifold is a single drum 50 about one-fifth the diameter of the upper water-and-steam drum 52. As can be seen the tubes 54 do not join the drums along a single straight line but the joinders are staggered as will be described in greater detail with reference to FIG. 7.

In the uppermost chamber 56 defined by the horizontal tube run 58 and the upper drum 52 insulation 60 is provided to insulate the tubes. Into the chamber from front to back there extend a plurality of pipes 62 which at one end are connected to a chamber (not shown) for admission of ambient air and at their other ends are connected to a chamber for receipt of the warmed air which is then supplied to a zone for the initial combustion. Thus in chamber 56 ambient air is preheated in pipes 62 by heat exchange with the combustion gas traversing the boiler. Since such combustion gas is cooled by the exchange the insulation 60 is provided to prevent cooling the water tubes 54 lining chamber 56.

The preheated air can be used as the supply to a gas or oil burner for the boiler or is especially suited for firing a turbine whose exhaust can be the combustion gas which powers the instant boiler, i.e. a co-generation system involving a turbine and a boiler to utilize the turbine waste heat. The use of preheated air serves to increase the overall efficiency.

Figure 7:
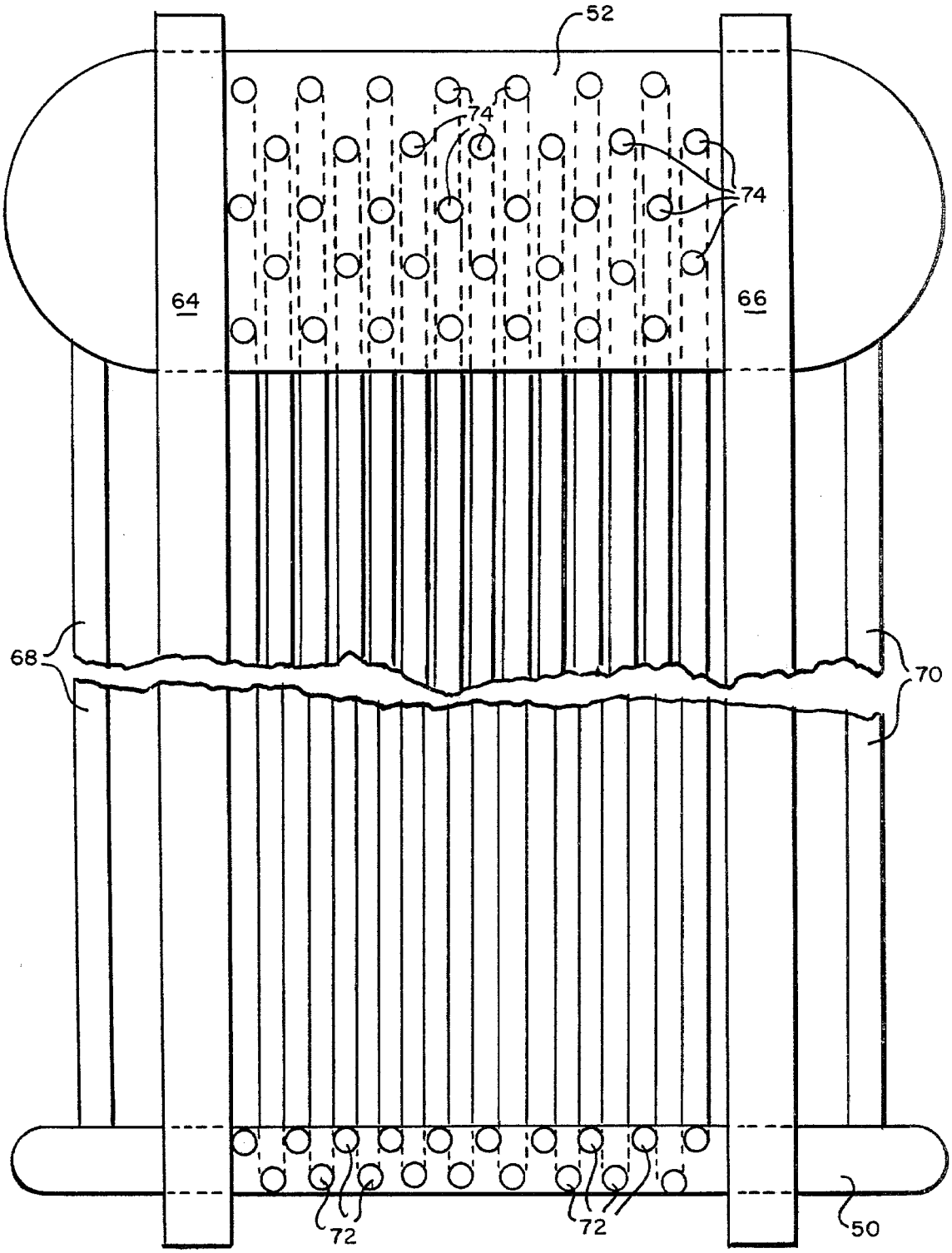
FIG. 7 is a side view of the upper and lower drums of a boiler in accordance with the invention showing their connection and where the tubes enter the drums.

In FIG. 7 the drums 50 and 52 of FIG. 6 are shown schematically. A pair of supports 64 and 66 support the drums to the left and right of the tubes (actually front and rear of the boiler) and downcomers 68 and 70 run from the upper drum 52 to the lower drum 50 to permit recirculation of some of the water in the upper drum.

The tubes are not shown but instead there can be seen the openings 72 and 74 through which the tubes communicate with the drums 50 and 52, respectively. It can be seen that the openings are not in a straight line but rather are staggered. As a consequence the distance between adjacent openings, i.e. the length of the ligaments, is much greater and this means the thickness of the drums to withstand a given pressure can be much less. This in turn reduces the cost and adds to the efficiency of the system.

Further, as a consequence of the preheating of the air ultimately intended to effect combustion, as in FIG. 6, the flue gases are cooled considerably. If they go below about 200° F. then the sulfur oxides and water vapor contained therein condense out as sulfuric acid. By providing an inclined tray below pipes 62 this acid can be collected and disposed of. Such extensive cooling thus reduces the sulfur oxide content of the flue gases with obvious advantages with regard to pollution. The flue gases can simply be vented without the need for a stack.

The novel boiler offers advantages with regard to nitrogen oxides (NOX) discharge as well. The NOX generation can be held to a minimum if combustion is under steady load and ideal conditions are established. However, where the load fluctuates there is a serious problem. In accordance with the present invention the radiation section, i.e. the burner, is controlled independently of the convection section, i.e. the heat exchanger. Specifically, if less steam is required so less fuel is burned, it is merely necessary to reduce the extent of baffling so the flue gas has a less tortuous path around baffles, so there is less heat exchange and so the gas temperature therefore is at about the same value as before, notwithstanding the reduced flue gas generation. The baffles also serve to create a back pressure upstream so that the furnace chamber is under substantially constant pressure and combustion conditions, resulting in ideal combustion with minimum NOX generation. Generally the baffles in the second chamber control the pressure in the furnace which is the chamber immediately preceding, while the baffles in the chamber immediately preceding the exit are controlled by the gas exit temperature, i.e. if the temperature rises baffling is increased to effect more heat exchange serving to reduce the gas exit temperature and restore it to the predetermined value.

In accordance with another feature not shown in the drawings, if superheated steam is needed it is possible to include tubing from the gas space of the steam drum passing through the second chamber on its way to use. The second chamber is the hottest beyond the furnace and can readily superheat gases piped therethrough.

The tubes, drums and manifolds may be formed of conventional boiler materials such as iron, steel, etc., and the boiler surfaces may be lined with refractory material, as desired.

The boiler shown in the drawings has four chambers above the combustion chamber but by appropriate bending of the tubes the number could be one to ten or more.

The number of tubes can also be varied but one suitable installation has the following parameters:

| | | |
|---|---|---|
| (1) | Steam drum diameter | 42" inches × 160' |
| (2) | Tube diameters | 2" inches |
| (3) | Number of tubes per side | 60 |
| (4) | Total number of chambers | 5 |
| (5) | Housing dimensions: | |
| | height | 11'0" |
| | width | 6'0" |
| | depth | 14'0" |

Certain advantages of the system have already been noted but there are many more. Specifically, the novel construction has the following advantages:

1. The ability to independently control the combustion chamber pressures at all firing rates makes the burning of any fuel more efficient and easier.

2. Controlled flue gas passages beyond the furnace section permits extracting the maximum heat from the gases.

3. Heat transfer rate 18,000 BTU/square foot of overall heating surface while the heat release within the furnace is kept to 60,000–75,000 BTU/cubic Ft. This, when compared to 10,000 BTU/square foot and 90,000 BTU/cubic foot makes this boiler design conservatively designed in the vital area while highly efficient and less costly in the balance.

4. The linear travel baffles increase the heat transfer and control the velocity of the flue gases through the boiler.

5. The boiler can be efficiently fired with gas, oil or coal by fluidized bed, underfeed and spreader stoker, pulverized burner, wood or any solid combustible fuel or even municipal waste.

6. The boiler gas passages are easily cleaned either manually or automatically.

7. The boiler is suitable for exhaust gas utilization.

8. The boiler meets the requirements of the ASME steam boiler construction code, Section 1, for low and high pressure steam, low and high temperature hot water, hot mineral oils and black liquor. The entrance of the tubes into the manifolds allows large ligaments between the tube holes. This results in the boiler drums being as little as only 30 percent of the thickness that is required in traditional boilers. This also allows the tubes to be attached to the drums by a driven morse taper rather than expanding the tube ends into the manifolds, which reduces labor costs in production and/or field assembly.

9. The boiler does not require external draft controls of any kind.

10. Super-heated steam can be provided easily at exactly the temperature required without elaborate controls.

11. The boiler pressure vessel forms a perfect rectangular cube with water cooled sides and thus eliminates the need for expensive refractories and insulation.

12. The boiler tubes provide free expansion and contraction in all areas.

13. The exit flue gas temperature can be reduced below the condensation point with a simple addition and environmental polutants such as sulphur oxides can be removed from the gases. This increases the efficiency of the boiler and meets the environmental emission levels without expensive flue gas scrubbers.

It will be appreciated that the instant specification and examples are set forth by way of illustration and not limitation and that various modifications and changes may be made without departing from the spirit and scope of the present invention.

I claim:

1. A boiler comprising a housing having a top provided with a gas outlet, bottom, left and right sides and a front and back, the housing containing an upper manifold and a lower manifold substantially parallel to the top, bottom and side walls, two sets of tubes, each set comprising a plurality of tubes, one set joining the upper manifold to the lower manifold on the left and the other set joining the upper manifold to the lower manifold on the right, the tubes of each set rising from the lower manifold upwardly along their respective side wall, crossing the housing to the opposite side wall, rising adjacent the opposite side wall, re-crossing the housing to their respective side wall, rising therealong and eventually joining the upper manifold, the horizontal runs of the tubes of one set being vertically offset relative to the horizontal runs of the tubes of the other set so as to form a plurality of superposed chambers, individual tubes of the sets being differently bent so as to form access openings from each chamber to the chambers above and below, the openings from chamber to chamber being offset so as to require a gas flowing through said chambers to traverse one chamber from front to back and the next chamber from back to front, means for introducing liquid into one of the manifolds and for withdrawing the liquid from the other manifold, and means for introducing a hot gas into the lowermost of the superposed chambers, the hot gas rising successively through the chambers which it successively and alternately traverses from front to back and then from back to front until it exits from the uppermost chamber through the gas outlet in the top, liquid flowing through the manifolds and tubes being heated by the hot gas, at least one baffle within at least one of the chambers extending from top to bottom and from one of the sides toward but terminating short of the other, whereby hot gas traversing that chamber from front to back is additionally forced to flow laterally to get around said baffle.

2. A boiler according to claim 1, wherein the tubes of each set are in substantial contact with one another so as substantially to prevent passage of hot gas therebetween.

3. A boiler according to claim 1, including means for adjusting the extent to which the baffle extends toward the other side, whereby adjusting the extent to which the baffles extend toward the other sides serves to modify the gas flow path and maintain substantially constant the pressure within the chambers and the hot gas exit temperature notwithstanding changes in the volumetric rate of flow of hot gas.

4. A boiler according to claim 1, including means within one of the upper chambers to preheat ambient air.

5. A boiler according to claim 1, including means extending from the outlet manifold through at least one of the upper chambers to superheat the gas leaving said manifold.

* * * * *